US005484198A

United States Patent [19]

Pilliod

[11] Patent Number: 5,484,198

[45] Date of Patent: Jan. 16, 1996

[54] DRAWER GUIDE ASSEMBLY

[75] Inventor: Peter P. Pilliod, Holland, Ohio

[73] Assignee: Progressive Furniture, Inc., Swanton, Ohio

[21] Appl. No.: 305,270

[22] Filed: Sep. 13, 1994

[51] Int. Cl.[6] ..... A47B 88/14

[52] U.S. Cl. ..... 312/334.18; 312/334.19; 312/334.21; 312/330.1

[58] Field of Search ..... 312/330.1, 334.18, 312/334.19, 334.21, 334.26, 334.39, 334.41, 334.42, 334.43; 384/19

[56] References Cited

U.S. PATENT DOCUMENTS

| | | | |
|---|---|---|---|
| 2,460,521 | 6/1945 | McMurtrie | 312/334.19 |
| 3,099,501 | 7/1963 | Hillson et al. | 312/334.21 X |
| 3,164,418 | 1/1965 | Biesecker | 384/19 |
| 3,215,476 | 11/1965 | Jacobs | 384/19 |
| 3,976,346 | 8/1976 | Grass . | |
| 4,173,380 | 11/1979 | Dupree . | |
| 4,508,394 | 4/1985 | Rock . | |
| 4,615,572 | 10/1986 | Nelson . | |
| 4,639,145 | 1/1987 | Lautenschlager . | |
| 5,090,787 | 2/1992 | Harley . | |
| 5,292,192 | 3/1994 | Lautenschlager . | |

FOREIGN PATENT DOCUMENTS

| | | | |
|---|---|---|---|
| 2047076 | 11/1980 | United Kingdom | 384/19 |

*Primary Examiner*—Jose V. Chen
*Assistant Examiner*—James O. Hansen
*Attorney, Agent, or Firm*—Donald R. Fraser

[57] ABSTRACT

A drawer guide assembly for use on each side of drawer includes an elongate guide rail for guiding associated rollers during relative movement between a drawer and an associated article of casement furniture, the relative movement is limited by a step structure at opposing ends of the guide rail.

5 Claims, 1 Drawing Sheet

DRAWER GUIDE ASSEMBLY

BACKGROUND OF THE INVENTION

The invention relates to a drawer guide assembly for drawers comprising, on each side of the drawer, a drawer side wall to which is attached an elongate drawer guide rail and the article of furniture is provided with side walls spaced apart sufficiently to receive the drawer, and roller pin assemblies attached to the side walls of the article of furniture. The roller means of this roller pin assembly are received within the drawer guide rails to enable in and out relative movement of the drawer and the article of furniture. Shoulder stop means are provided in association with the guide rails to limit the relative movement.

DESCRIPTION OF THE PRIOR ART

Drawer guide assemblies including guide rails and associated roller means are frequently used in the furniture field. In such assemblies it is perhaps more conventional to attach the guide rails to the side walls of the drawers while the associated roller means are mounted on the side walls of the article of furniture. However, the objective function may be likewise achieved by a reversal of the parts. In either application, in prior art assemblies there was a requirement to utilize left hand and right hand guide rails.

As in most all manufacturing practices it is a desideratum to provide a finished product with equal or increased functional, aesthetic, and utilitarian properties at even lower costs.

SUMMARY OF THE INVENTION

It is an object of the present invention to produce a drawer guide assembly of the aforementioned type in which a single guide rail of the invention may be used for left hand or right hand assembly.

Another object of the invention is to produce a drawer guide assembly in which the guide rail may be readily fabricated from materials such as plastic or metal for example.

The above as well as other aspects and advantages of the invention may be achieved by a drawer guide assembly for use on each of opposite sides of a drawer and an article of furniture of the type which a drawer is slidably insertable into and removable from the article of furniture, the assembly comprising a drawer having opposed side walls; an article of furniture into and out of which the drawer is designed to travel, the article having opposed side walls spaced apart sufficiently to receive the drawer; roller pin assemblies; means for attaching at least two of the roller pin assemblies to the opposed side walls of either the drawer or article of furniture; elongate guide rail assemblies for receiving and guiding the roller pin assemblies, the rail assemblies including a central web, a lower flange extending laterally from the web and terminating at each end with an upstanding shoulder, and an upper flange parallel with and spaced from the lower flange and terminating to form an opening between each of the respective ones of upstanding shoulders of the lower flange to provide an opening to receive the roller pin assemblies; and means for attaching rail assemblies to the drawer or article of furniture to which the roller pin assemblies were not attached.

BRIEF DESCRIPTION OF THE DRAWINGS

The above advantages and objects of the invention will become manifest to those skilled in the art from reading the following detailed description of an embodiment of the invention when considered in the light of the attached drawings in which.

DETAILED DESCRIPTION OF THE PREFERRED EMBODIMENTS

Figure 1:
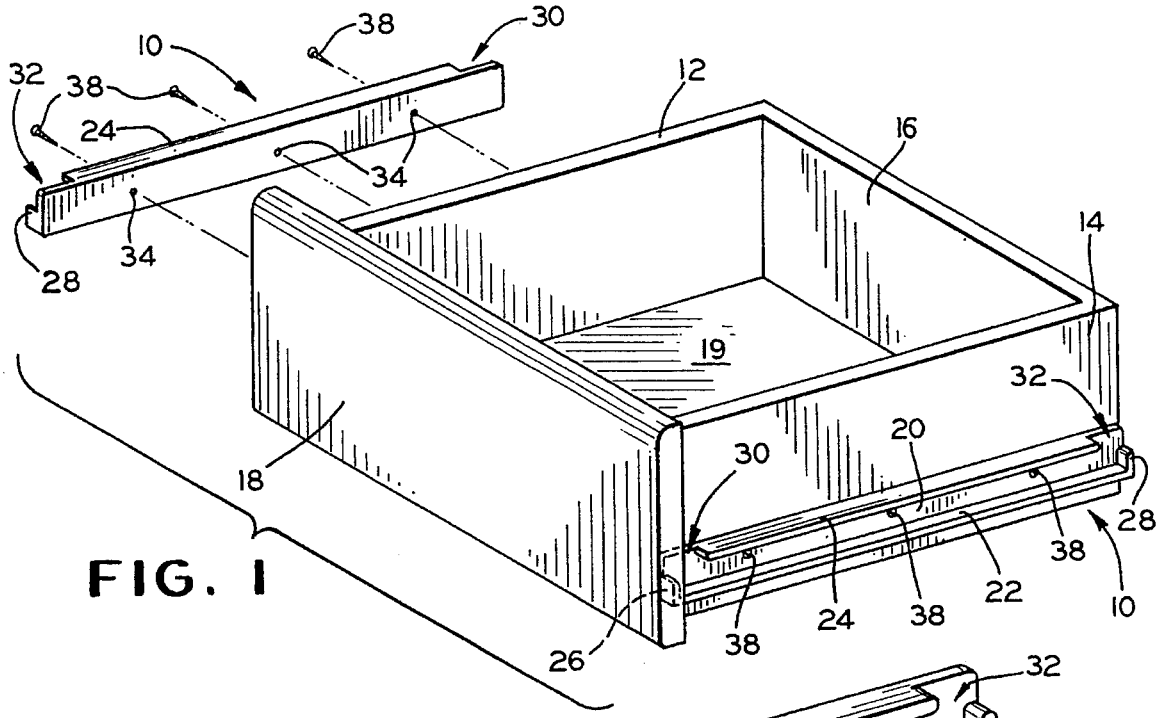
FIG. 1 is a perspective exploded view of a drawer provided with a guide rail assembly incorporating the features of the invention.
Figure 2:
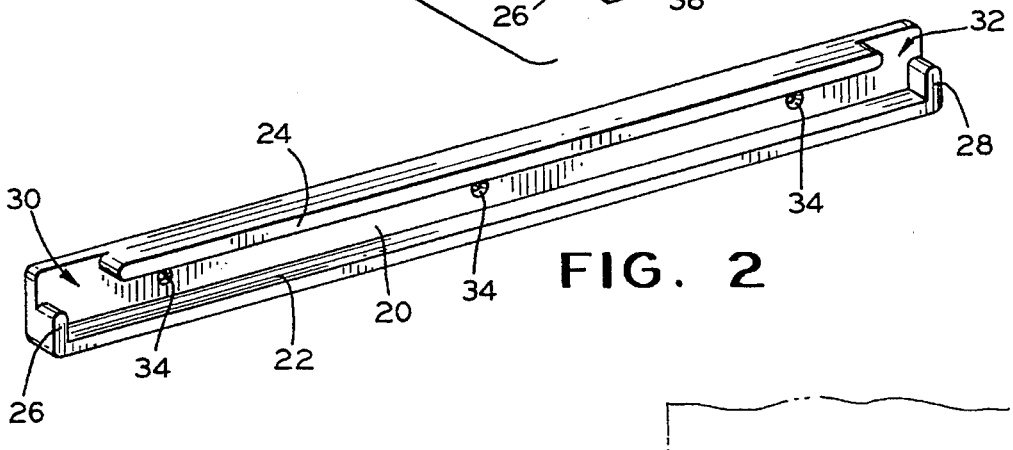
FIG. 2 is an enlarged perspective view of one of the elongate guide rails illustrated in FIG. 1.
Figure 3:
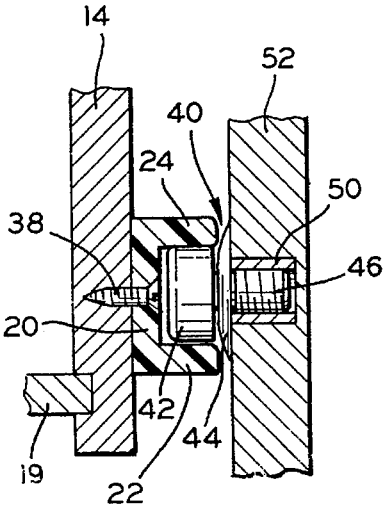
FIG. 3 is an enlarged fragmentation sectional view of a drawer guide assembly to utilizing the feature of the invention.

The drawer guide assembly embodying the features of the invention is illustrated in the drawings and includes an elongate drawer guide rail 10. It will be understood that each drawer guide assembly typically utilizes a guide rail 10 on each side of an associated drawer. Since the guide rails 10 are identical with one another, only single side will be explained in detail.

The guide rials 10 are adapted to be fastened to the outer surface of the left hand side wall 12 and the right hand side wall 14. The drawer also includes a rear wall 16, a front panel 18, and a bottom panel 19. The side walls, 12, 14 the rear wall 16, the front panel 18, and the bottom panel 19 are assembled with known methods. The front panel 18 is typically of greater width than the distance between the side wall 12 and 14 to ensure that the drawer assembly will stop moving into the associated article of furniture when the inner face of the panel 18 contacts the front edges of the opening provided in the article of furniture.

The guide rail 10 is formed to include a central web 20, a lower flange 22 which substantially coextensive with the central web 20, an upper flange 24 is spaced from the lower flange 22 and extends parallel thereto. The flanges 22 and 24 extend laterally from a surface of the central web 20.

The upper flange 24 is formed to terminate a distance inwardly of the ends of the web portion 20.

Upwardly extending shoulders 26 and 28 are formed at the terminal ends of the lower flange 22. The uppermost ends of the shoulders 26 and 28 are spaced from the respective terminal ends of the upper flange 24 to defuse respective orifices 30 and 32 provided to receive roller pin assemblies as will be hereinafter explained.

The central web 20 is provided with a plurality of spaced apertures 34 of a size to receive threaded fasteners such as screws 38, for example. In the illustrated embodiment of the invention, the guide rails 10 are attached to the side walls 12 and 14 by screws 38 which are received by the apertures 34 and are secured within the side walls of the drawer. In the illustrated embodiment, the drawer and the associated article of furniture are preferably constructed of wood, while the guide rails 10 are typically formed of a plastic material. The plastic material for the guide rails 10 may be polystyrene or other compositions which can be satisfactorily employed in injection molding machines to satisfactorily form the guide rails 10 of the invention.

In order to support the guide rails 10 and the associated drawer for in and out movement within an article of furniture, a plurality of roller pin assemblies 40 is used. The assemblies 40 include a roller 42, an annular levelled contract bearing surface element 44, and an externally threaded support shank 46. Associated internally threaded cylindrical sleeves 50 may be provided to be inserted in drilled holes in the inner surface of the side wall 52 of the associated article of furniture. The cylindrical sleeve 50 is adapted to threadably receive the roller pin assemblies 40. Typically, two roller pin assemblies 40 are attached to the inner side walls of the article of furniture to suitably carry the load of the drawers and provide for in and out movement of the drawer relative to the article of furniture.

Satisfactory results have occurred by utilizing roller pin assemblies 40 wherein the rollers 42 and the contact surfaces 44 are formed of a plastic or plastic coated material.

Figure 4:
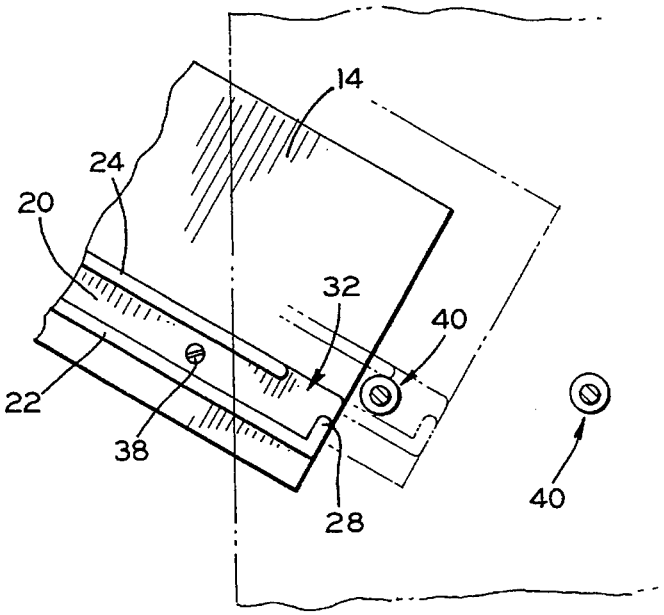
FIG. 4 is a fragmentation schematic elevational view illustrating the mode of assembling the drawer assembly of the invention.

The drawer guide assembly is installed by tilting the drawer slightly, as schematically illustrated in FIG. 4, and urging the roller 42 of the most adjacent roller pin assembly 40 to be received within the orifice 32 and thence guided into the space between the lower flanges 22 and the upper flange 24. The drawer is continued to moved inwardly until the orifice 32 meets the innermost roller pin assembly 40.

It will be understood that as the drawer is being inserted each of the two guide rails 10 function in generally the same manner in receiving the respective roller pin assemblies 40.

The upstanding shoulder 30 and 28 cooperate to limit outward movement of the drawer. More specifically in the illustrated embodiment the upstanding shoulders 30 and 28 of the left and right hand guide rails 10 limit the opening movement when the rollers 42 of the outermost roller pin assemblies 40 contact the upstanding shoulders 30 and 28. Thus, the assembly prevents accidental removal of the drawer.

From considering the aforedescribed structure, it is readily apparent that only a single guide rail of the structure illustrated may be used on either side thus requiring only a single die to fabricate the rails.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A drawer guide assembly for use on each of opposite side walls of a drawer and an article of furniture of the type which a drawer is slidably insertable into and removable from the article of furniture, the assembly comprising:

roller pin assemblies;

means for attaching at least two of said roller pin assemblies to the opposite side walls of either the drawer or the article of furniture;

elongate guide rail assemblies for receiving and guiding said roller pin assemblies, said rail assemblies including a central web, a lower flange extending laterally from the web and terminating at each end with an upstanding shoulder, and an upper flange parallel with and spaced from the lower flange and terminating to form an opening between each of the respective ones of the upstanding shoulders of the lower flange to provide an opening to receive [said]the roller pin assemblies; and means for attaching said rail assemblies to [said]the drawer or the article of furniture to which said roller pin assemblies were not attached.

2. A drawer guide assembly as defined in claim 1 wherein the lower flange of said rail assembly is substantially coextensive with the central web of said rail assembly.

3. A drawer guide assembly as defined in claim 2 wherein the central web of said rail assembly is provided with a plurality of spaced apart threaded fastener receiving apertures.

4. A drawer guide assembly as defined in claim 1 wherein said guide rails are formed of a plastic material.

5. A drawer guide assembly for use on each of opposite side walls of a drawer and an article of furniture of the type which a drawer is slidably insertable into and removable from the article of furniture, the assembly comprising:

roller pin assemblies;

means for attaching said roller pin assemblies to one of the side walls;

elongate guide rail assemblies for receiving and guiding said roller pin assemblies, said rail assemblies including a central web, a lower flange extending laterally from the web and terminating at each end with a roller stop, and an upper flange parallel with and spaced from the lower flange and terminating to form an opening between each of the respective ones of the roller stop of the lower flange to provide an opening to receive said roller pin assemblies; and means for attaching said rail assemblies to the other of the side walls.

* * * * *